US010900715B2

(12) United States Patent
Pilote et al.

(10) Patent No.: US 10,900,715 B2
(45) Date of Patent: Jan. 26, 2021

(54) SLAG NOTCH

(71) Applicant: Tata Steel Limited, Mumbai (IN)

(72) Inventors: Jacques Pilote, Woodlands (AU); Mark Hayton, Bateman (AU)

(73) Assignee: Tata Steel Limited, Mumbai (IN)

( * ) Notice: Subject to any disclaimer, the term of this patent is extended or adjusted under 35 U.S.C. 154(b) by 115 days.

(21) Appl. No.: 15/566,251

(22) PCT Filed: Apr. 14, 2016

(86) PCT No.: PCT/AU2016/050274
§ 371 (c)(1),
(2) Date: Oct. 13, 2017

(87) PCT Pub. No.: WO2016/164979
PCT Pub. Date: Oct. 20, 2016

(65) Prior Publication Data

US 2018/0112917 A1 Apr. 26, 2018

(30) Foreign Application Priority Data

Apr. 14, 2015 (AU) ..... 2015901323

(51) Int. Cl.

| | |
|---|---|
| ***C21B 3/04*** | (2006.01) |
| ***F27D 3/15*** | (2006.01) |
| ***F27D 1/12*** | (2006.01) |
| *F27D 9/00* | (2006.01) |

(52) U.S. Cl.
CPC ..... *F27D 3/1554* (2013.01); *C21B 3/04* (2013.01); *F27D 1/12* (2013.01); *F27D 3/1545* (2013.01); *F27D 2009/0067* (2013.01)

(58) Field of Classification Search
CPC ..... F27D 3/1554; C21B 3/04
See application file for complete search history.

(56) References Cited

U.S. PATENT DOCUMENTS

| | | | | |
|---|---|---|---|---|
| 2,409,337 | A | 10/1946 | Yuhas | |
| 2,687,347 | A * | 8/1954 | Danulat | C10J 3/08 48/87 |
| 4,095,777 | A | 6/1978 | Honaker | |
| 4,225,122 | A * | 9/1980 | Dorling | C21B 7/10 266/193 |

(Continued)

FOREIGN PATENT DOCUMENTS

| | | | |
|---|---|---|---|
| CN | 202793023 | U | 3/2013 |
| WO | 9631627 | A1 | 10/1996 |
| WO | 00/022176 | A1 | 4/2000 |

OTHER PUBLICATIONS

McDougall I., "Water-cooled tap-hole blocks", Furnace Tapping Conference 2014, The Southern African Institute of Mining and Metallurgy, Muldersdrift, South Africa, May 27-29, 2014, pp. 183-192, [online] [retrieved from internet on Aug. 27, 2015] <URL: https://web.archive.org/web/20150314235045/http://saimm.co.za/publications/conference-papers> published on Mar. 14, 2015 as per Wayback Machine.

(Continued)

*Primary Examiner* — Scott R Kastler
(74) *Attorney, Agent, or Firm* — Banner & Witcoff, Ltd.

(57) ABSTRACT

A slag notch for a metallurgical vessel includes a steel member that defines a passageway for molten slag and a system for cooling the steel member.

17 Claims, 6 Drawing Sheets

(56) References Cited

U.S. PATENT DOCUMENTS

| | | | | |
|---|---|---|---|---|
| 6,404,799 | B1 * | 6/2002 | Mori | E02F 9/2225 373/71 |
| 7,510,679 | B2 | 3/2009 | Motomura et al. | |
| 2009/0031858 | A1 * | 2/2009 | Farr | C21B 11/08 75/485 |

OTHER PUBLICATIONS

Jun. 10, 2016—International Search Report and Written Opinion of PCT/AU2016/50274.

Van Beek, W.S.B et al., "An overview of the design, operation, and maintenance practices relating to tap-hole management of a PGM smelting furnace", Furnace Tapping Conference 2014, The Southern African Institute of Mining and Metallurgy, Muldersdrift, South Africa, May 27-29, 2014, pp. 113-128, [online] [retrieved from internet on Aug. 27, 2015] <URL:https://web.archive.org/web/20150314235045/http://saimm.co.za/publications/conference-papers> published on Mar. 14, 2015 as per Wayback Machine [hereinafter referred to as D1].

Aug. 31, 2015—Australian International—Type Search Report for AU2015901323.

* cited by examiner

SLAG NOTCH

CROSS-REFERENCE TO RELATED APPLICATIONS

The present application is a U.S. National Phase filing of International Application No. PCT/AU2016/050274, filed on Apr. 14, 2016, and claiming priority to Australian Patent Application No. 2015901323 filed Apr. 14, 2015. The present application claims priority to and the benefit of all the above-identified applications, which are all incorporated by reference herein in their entireties.

TECHNICAL FIELD

The invention relates to metallurgical vessels that contain a bath of molten slag and molten metal.

More particularly, the invention relates to a slag notch in a side wall of a metallurgical vessel that defines a passageway through the side wall that allows molten slag to be drained from the metallurgical vessel during an operating campaign of a metallurgical process in the vessel.

The invention has particular application, although not exclusive application, to metallurgical vessels for a metallurgical process for direct smelting a metalliferous material, such as iron ore, to molten metal.

BACKGROUND

A known molten bath-based metallurgical process for direct smelting a metalliferous material is generally referred to as the "HIsmelt" process and is described in a considerable number of patents and patent applications in the name of the applicant.

The HIsmelt process is applicable to smelting metalliferous material generally but is associated particularly with producing molten iron from iron ore or another iron-containing material.

In the context of producing molten iron, the HIsmelt process includes the steps of:

(a) forming a bath of molten iron and slag in a main chamber of a direct smelting vessel;

(b) injecting into the molten bath: (i) iron ore, typically in the form of fines; and (ii) a solid carbonaceous material, typically coal, which acts as a reductant of the iron ore feed material and a source of energy; and (c) smelting iron ore to iron in the bath.

The term "smelting" is herein understood to mean thermal processing wherein chemical reactions that reduce metal oxides take place to produce molten metal.

In the HIsmelt process solid feed materials in the form of metalliferous material (which may be pre-heated) and carbonaceous material and optionally flux material are injected with a carrier gas into the molten bath through a number of water-cooled solids injection lances which are inclined to the vertical so as to extend downwardly and inwardly through a side wall of the main chamber of the smelting vessel and into a lower region of the vessel so as to deliver at least part of the solid feed materials into the metal layer in the bottom of the main chamber. The solid feed materials and the carrier gas penetrate the molten bath and cause molten metal and/or slag to be projected into a space above the surface of the bath and form a transition zone. A blast of oxygen-containing gas, typically oxygen-enriched air or pure oxygen, is injected into an upper region of the main chamber of the vessel through a downwardly extending lance to cause post-combustion of reaction gases released from the molten bath in the upper region of the vessel. In the transition zone there is a favourable mass of ascending and thereafter descending droplets or splashes or streams of molten metal and/or slag which provide an effective medium to transfer to the bath the thermal energy generated by post-combusting reaction gases above the bath.

Typically, in the case of producing molten iron, when oxygen-enriched air is used, the oxygen-enriched air is generated in hot blast stoves and fed at a temperature of the order of 1200° C. into the upper region of the main chamber of the vessel. If technical-grade cold oxygen is used, the technical-grade cold oxygen is typically fed into the upper region of the main chamber at or close to ambient temperature.

Off-gases resulting from the post-combustion of reaction gases in the smelting vessel are taken away from the upper region of the smelting vessel through an off-gas duct.

The smelting vessel includes a forehearth connected to the main chamber via a forehearth connection that allows continuous metal product outflow from the vessel. The main chamber includes refractory-lined sections in a lower hearth and water-cooled panels in side walls and a roof of the main chamber. Water is circulated continuously through the panels in a continuous circuit. The forehearth operates as a molten metal-filled siphon seal, naturally "spilling" excess molten metal from the smelting vessel as it is produced. This allows the molten metal level in the main chamber of the smelting vessel to be known and controlled to within a small tolerance—this is essential for plant safety.

Another molten bath-based metallurgical process for direct smelting a metalliferous material is referred to hereinafter as the "HIsarna" process. The process is carried out in a smelting apparatus that includes (a) a smelting vessel that includes a main chamber that is adapted to contain a bath of molten iron and slag and solids injection lances and oxygen-containing gas injection lances extending into the main chamber and (b) a smelt cyclone for pre-treating a metalliferous feed material that is positioned above and communicates with the smelting vessel. The HIsarna process and apparatus are described in International application PCT/AU99/00884 (WO 00/022176) in the name of the applicant.

The term "smelt cyclone" is understood herein to mean a vessel that typically defines a cylindrical chamber and is constructed so that feed materials supplied to the chamber move in a path around a vertical central axis of the chamber and can withstand high operating temperatures sufficient to at least partially smelt metalliferous feed materials.

In one form of the HIsarna process, carbonaceous feed material (typically coal) and flux (typically limestone) are injected into a molten bath in the smelting vessel via the solids injection lances. Metalliferous feed material, such as iron ore, is injected into and heated and partially melted and partially reduced in the smelt cyclone. This molten, partly reduced metalliferous material flows downwardly from the smelt cyclone into the molten bath in the smelting vessel and is smelted to molten metal in the bath. Hot, reaction gases (typically CO, $CO_2$, $H_2$, and $H_2O$) produced in the molten bath are partially combusted by oxygen-containing gas (typically technical-grade oxygen) in an upper part of the smelting vessel. Heat generated by the post-combustion is transferred to molten material in the upper section that falls back into the molten bath to maintain the temperature of the bath. The hot, partially-combusted reaction gases flow upwardly from the smelting vessel and enter the bottom of the smelt cyclone. Oxygen-containing gas (typically technical-grade oxygen) is injected into the smelt cyclone via tuyeres that are arranged in such a way as to generate a cyclonic swirl pattern in a horizontal plane, i.e. about a vertical central axis of the chamber of the smelt cyclone. This injection of oxygen-containing gas leads to further combustion of smelting vessel gases, resulting in very hot (cyclonic) flames. Finely divided incoming metalliferous feed material is injected pneumatically into these flames via tuyeres in the smelt cyclone, resulting in rapid heating and partial melting accompanied by partial reduction (roughly 10-20% reduction). The reduction is due to CO and $H_2$ in the reaction gases from the smelting vessel. The hot, partially melted metalliferous feed material is thrown outwards onto the walls of the smelt cyclone by cyclonic swirl action and, as described above, flows downwardly into the smelting vessel below for smelting in that vessel.

The net effect of the above-described form of the HIsarna process is a two-step countercurrent process. Metalliferous feed material is heated and partially reduced by outgoing reaction gases from the smelting vessel (with oxygen-containing gas addition) and flows downwardly into the smelting vessel and is smelted to molten iron in the smelting vessel. In a general sense, this countercurrent arrangement increases productivity and energy efficiency.

In both the HIsmelt process and the HIsarna process the slag inventory in the smelting vessel builds up during the course of operating the processes and is reduced by periodically tapping slag from a slag notch in a side wall of the vessel to maintain an inventory that is suitable for operating the processes.

Typically, the slag notch is located in the vessel side wall above the level of the ends of the solids injection lances extending into the main chamber of the vessel so that the ends of the lances are always immersed in slag during standard operating conditions of the process.

Typically, a smelting campaign for the HIsmelt process and the HIsarna processes is at least 12 months continuous operation.

During the course of standard operating conditions of an HIsmelt or an HIsarna smelting campaign in a smelting vessel, molten metal is tapped continuously via the forehearth and molten slag is tapped periodically via the slag notch. More particularly, the level of molten slag in the smelting vessel is allowed to build up until the slag level reaches a pre-selected height and slag is then tapped from the vessel via the slag notch to the level of the slag notch. This process of slag build up and periodic slag tapping is repeated during the course of the smelting campaign.

The slag notch defines a passageway for discharging molten slag from the smelting vessel, with the passageway extending through the side wall of the smelting vessel. Typically, the passageway is closed by a suitable plugging material, such as clay, between slag taps. When it is time for a slag tap, a drill assembly drills through the plugging material and creates an open passageway for slag flow. The open passageway is closed at the end of the slag tap by forcing, for example by ramming, new plugging material into the open passageway or otherwise closing the open passageway.

The slag notch is an important structural feature of the smelting vessel from the perspective of safe operation of a smelting process in the vessel and from the perspective of operating the process for a full smelting campaign.

The periodic opening and closing of the passageway in the slag notch and the periodic flow of molten slag through the slag notch requires a robust and reliable slag notch structure.

The slag notch requirements are more onerous with the aggressive turbulent slags of the HIsmelt process and the HIsarna process than with other direct smelting processes.

In addition, irrespective of the smelting process, or the other metallurgical processes carried out in other metallurgical vessels having slag notches, the slag notch structure has to be able to accommodate slag and in some instances metal solidifying in the passageway during or between slag taps.

Typically, the metal is from very small droplets or metal splashes suspended in molten slag. The metal may solidify as metal tongues that get larger with time and can interfere with plugging the passageway after a slag tap or opening a closed passageway to commence a new slag tap.

If the slag notch is not closed properly, for example due to solidified metal in the slag notch, it will have a continuous blow of hot and dangerous process gas that will result ultimately in an interruption of the process to address the issue.

If solidified metal in the slag notch interferes with opening a closed passageway, the use of oxy-lancing may be required and this will accelerate the damage to the internal structure of the slag notch and may the heat of the lancing process may cause severe damage to the water-cooled structure of the slag notch.

The above description is not to be taken as an admission of the common general knowledge in Australia or elsewhere.

SUMMARY OF THE DISCLOSURE

Accordingly, the invention provides a slag notch for periodically discharging molten slag from a metallurgical vessel containing a bath of molten metal and molten slag, the slag notch including a steel member that defines a passageway for molten slag, the passageway having an inlet for molten slag at one end of the passageway and an outlet for discharging molten slag from the passageway at the other end of the passageway, and a system for cooling the steel member.

The applicant has found that the steel member makes it possible for the slag notch to retain structural integrity at the operating temperature of the vessel and, more particularly, at the temperature of molten slag discharged via the slag notch, when the steel member is cooled, for example by being directly or indirectly water cooled. In this context, the use of the steel member is advantageous because it is far less susceptible to damage than current slag notch options.

The passageway may be a constant diameter for the length of the passageway from the inlet end to the outlet end of the passageway.

The diameter of the passageway may be different in different parts of the length of the passageway from the inlet end to the outlet end of the passageway.

The passageway may include a first section that has a constant diameter or a nearly constant diameter for a part of the length of the passageway from the inlet end of the passageway with the nearly constant diameter first section including a slightly larger diameter at the inlet end. The passageway may include a second section that has a larger diameter than the first section for the remainder of the length of the passageway to the outlet end of the passageway. This arrangement makes it possible to minimise the diameter at the slag inlet end of the passageway to minimise the possibility of metal intrusions into the passageway, facilitate drainage of any liquid metal settling in the passageway before solidification, or facilitate expelling any metal during drilling or plugging steps if the metal solidifies in the passageway.

The second section of the passageway may be a conical shape that increases in diameter towards the outlet end of the passageway to facilitate positioning a mud gun or other suitable apparatus for forcing a plugging material into the passageway to close the passageway at an end of a slag tap.

The second section may be a constant diameter.

The diameter of the second section may be different at different parts of the length of the second section.

The passageway may include a transition between the first and the second sections of the passageway.

The transition may be a shoulder or any other suitable formation between the first and the second sections of the passageway.

The steel member may include a forward end, a rear end, and an inner wall (which defines the passageway) and an outer wall extending between the rear end and the forward end. With this arrangement, there is an annular space between the inner wall and the outer wall.

The outer wall of the steel member may be frusto-conical, increasing in diameter from the forward end to the rearward end.

The steel member may be a solid member.

The system for cooling the steel member may be adapted to cool the steel member internally via coolant flow, such as water flow, within the steel member.

The steel member may be a water-cooled steel member.

One, although not the only, example of a water-cooled steel member is a water-cooled steel jacket.

The water-cooled steel jacket may have a forward end, a rear end, an inner wall (which defines the passageway) and an outer wall extending between the rear end and the forward end, a bullnose at the forward end adjacent the inlet end of the passageway, and water flow passages within the jacket.

Another, although not the only other, example of a water-cooled steel member is a water-cooled steel sleeve.

The steel sleeve may have a forward end, a rear end, an inner wall (which defines the passageway) and an outer wall extending between the rear end and the forward end, and water flow passages within the sleeve.

The system for cooling the steel member may be adapted to cool the steel member indirectly via heat exchange between the steel member and a heat extraction element positioned in relation to the steel member.

The heat extraction element may be positioned around and in heat transfer relationship with the steel member at least substantially along the length of the steel member between the inlet end and the outlet end of the passageway.

The heat extraction element may be formed from copper or any other suitable high thermal conductivity material.

The heat extraction element and the steel member may be separate units.

The heat extraction element may be a solid element and rely on the thermal mass to provide sufficient cooling of the steel member.

The heat extraction element may be water-cooled. The heat extraction element may be adapted to operate with any suitable coolant.

The heat extraction element may include a jacket having a forward end, a rear end, an inner wall and an outer wall extending between the rear end and the forward end, a bullnose at the forward end adjacent the inlet end of the passageway, and water flow passages within the jacket.

The heat extraction element may include a system for monitoring the heat load on element.

The slag notch may include a retaining element such as a plate for coupling the steel member and the jacket to the vessel, such as a side wall of the vessel, and for retaining the steel member in an internal space defined by the jacket so that the inner wall of the jacket and an outer wall of the steel member are in close contact across the whole of the surface areas of these walls at least substantially along the length of the steel member between the inlet end and the outlet end of the passageway to maximise heat transfer from the steel member to the jacket.

In order to assemble the jacket and the steel member together, the steel member may be inserted into the internal space defined by the jacket so that the member and the jacket are in an operative position with the jacket positioned around the steel member at least substantially along the length of the steel member and the retaining element is positioned to bear against the steel member and is bolted or otherwise connected to the smelting vessel to couple the steel member and the jacket to the side wall of the vessel and to prevent withdrawal of the steel member from the internal space and thereby hold the steel member and the jacket in the operative position.

The retaining element may be a separate member to the steel member and the jacket.

The retaining element may be connected, for example by being welded, to the steel member.

The slag notch may include a plurality of bolts or other coupling members that couple the element to the jacket.

The steel member may be a solid steel sleeve.

The inlet end of the jacket may include a lip that extends inwardly and defines an annular recess, with the steel member extending into the recess. The arrangement defines a tortuous flow path for molten slag and minimises the risk of molten slag flowing through the passageway and penetrating between the steel member and the copper jacket.

The steel may be any suitable steel.

By way of example, the steel may be selected from a low carbon steel, a medium carbon steel, and a high carbon steel.

According to the present invention there is also provided a metallurgical vessel that includes the above-described slag notch in the vessel.

The slag notch may be positioned in a side wall of the vessel.

The vessel may include one or more solids injection lance extending downwardly and inwardly through a side wall of the vessel for injecting metalliferous material and/or carbonaceous material into the molten bath.

The vessel may include one or more lances for injecting oxygen-containing gas into a gas space in the vessel above the molten bath.

The vessel may include a forehearth that, during normal production, continuously taps molten metal from the vessel via an overflow weir and that includes a tap hole below the overflow weir to decrease the metal in the metallurgical vessel to below the level of the slag drain.

The vessel may be a HIsmelt vessel or a HIsarna vessel as described above.

According to the present invention there is also provided a molten bath-based metallurgical process for direct smelting a metalliferous material in a metallurgical vessel that includes the above-described slag notch in the vessel, the process including periodically tapping molten slag from the slag notch, and cooling the slag notch to maintain the steel member of the slag notch in a safe operating temperature range for slag tapping.

The process may include monitoring the heat load on the heat extraction element of the slag notch.

BRIEF DESCRIPTION OF THE DRAWINGS

The invention is described further, by way of example only, with reference to the accompanying drawings, of which.

DESCRIPTION OF EMBODIMENT

Although the following description is in the context of a HIsmelt vessel, it will be appreciated that the invention is applicable to other metallurgical vessels that contain a bath of molten slag and molten metal, including HIsarna vessels. It will also be appreciated that the vessels of the invention are not confined to vessels for carrying out direct smelting processes.

Figure 1:
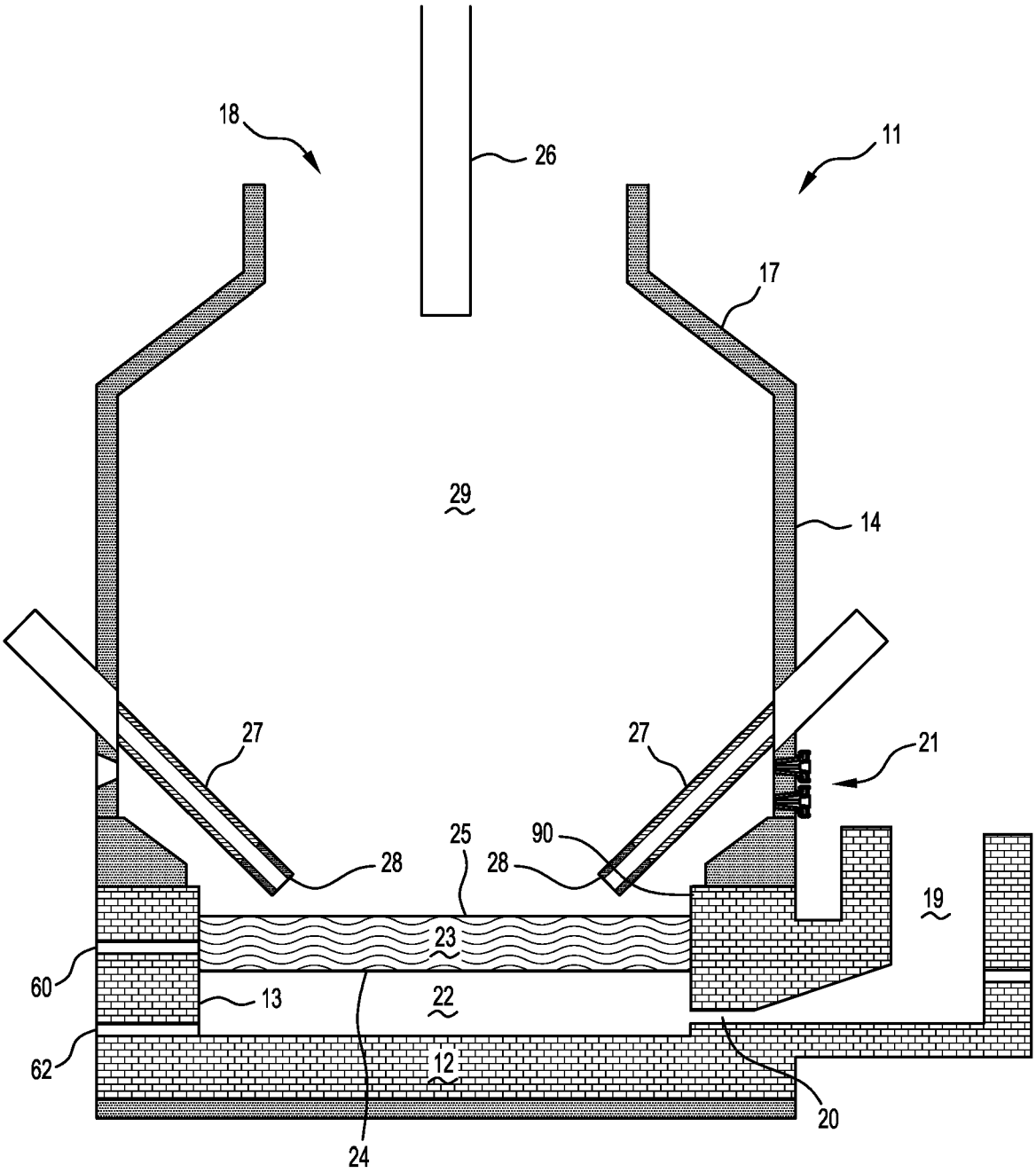
FIG. 1 is a vertical cross-section through an embodiment of a HIsmelt direct smelting vessel in accordance with the invention.

FIG. 1 shows a direct smelting vessel 11 that is suitable particularly for carrying out the HIsmelt process as described by way of example in International patent application PCT/AU96/00197 (WO 1996/031627) in the name of the applicant. The disclosure in WO 1996/031627 is incorporated herein by cross-reference.

The following description is in the context of smelting iron ore fines to produce molten iron in accordance with the HIsmelt process.

It will be appreciated that the present invention is applicable to smelting any metalliferous material, including ores, partly reduced ores, and metal-containing waste streams via any suitable molten bath-based direct smelting process and is not confined to the HIsmelt process. It will also be appreciated that the ores can be in the form of iron ore fines.

The vessel 11 has a hearth that includes a base 12 and sides 13 formed from refractory bricks, side walls 14, which form a generally cylindrical barrel extending upwardly from the sides 13 of the hearth, and a roof 17. Water-cooled panels (not shown in FIG. 1 but shown in FIG. 3) are provided in the side walls 14 for transferring heat from the side walls 14 and the roof 17. The roof 17 is provided with an outlet 18 through which process off gases are discharged during operation of a smelting process in the vessel 11. The vessel 11 is further provided with a forehearth 19 through which molten metal is continuously discharged during smelting. The forehearth 19 is open to the atmosphere. The forehearth 19 is connected to the interior of the vessel 11 via a forehearth connection 20 so that molten metal can flow into the forehearth 19 from the vessel 11. The vessel 11 further includes a slag notch 21 through which molten slag is periodically discharged from the vessel 11 during a smelting campaign in the vessel 11.

In the case of the HIsmelt process, typically, a smelting campaign is at least 12 months continuous operation and during the course of standard operating conditions in the smelting campaign, molten metal is tapped continuously via the forehearth 19 and molten slag (which, in practice, may contain some entrained metal droplets or splashes) is tapped periodically via the slag notch 21. Typically, there is a slag tap every 2-3 hours. It is noted that the invention is not confined to any particular time periods between slag taps.

In use of the vessel 11 to smelt iron ore fines to produce molten iron in accordance with the HIsmelt process, the vessel 11 contains a bath of molten iron and molten slag, which includes a layer 22 of molten metal and a layer 23 of molten slag on the metal layer 22. The position of the nominal quiescent surface of the metal layer 22 is indicated by arrow 24. The position of the nominal quiescent surface of the slag layer 23 is indicated by arrow 25. The term "quiescent surface" is understood to mean the surface when there is no injection of gas and solids into the vessel 11.

The vessel 11 is provided with solids injection lances 27 that extend downwardly and inwardly through openings (not shown) in the side walls 14 of the vessel and into the slag layer 23 when a smelting process is being carried out in the vessel 11. As is described further below, the molten slag expands upwardly during operation of the process. Two solids injection lances 27 are shown in FIG. 1. However, it can be appreciated that the vessel 11 may have any suitable number of such lances 27. In use, heated iron ore fines and ambient temperature coal (and fluxes, typically lime) are entrained in a suitable carrier gas (such as a free oxygen-deficient carrier gas, typically nitrogen) and are separately supplied to the lances 27 and co-injected through outlet ends 28 of the lances 27 into the molten bath and preferably into metal layer 22.

The outlet ends 28 of the solids injection lances 27 are above the surface of the metal layer 22 during operation of the process. This position of the lances 27 reduces the risk of damage through contact with molten metal and also makes it possible to cool the lances by forced internal water cooling without significant risk of water coming into contact with the molten metal in the vessel 11.

The vessel 11 also has a gas injection lance 26 for delivering a hot air blast into an upper region of the vessel 11. The lance 26 extends downwardly through the outlet 18 in the roof 17 of the vessel 11 into the upper region 29 of the vessel 11. In use, the lance 26 receives an oxygen-enriched hot air flow through a hot gas delivery duct (not shown), which extends from a hot gas supply station (also not shown).

The vessel 11 further includes an end-tap slag drain hole 60 in the side 13 of the base 12 which is, under quiescent conditions, at a level of the interface between the metal layer 22 and slag layer 23.

The vessel 11 further includes an end-tap metal drain hole 62 in the side 13 of the base 12 and adjacent the floor of the vessel 11.

Figure 2:
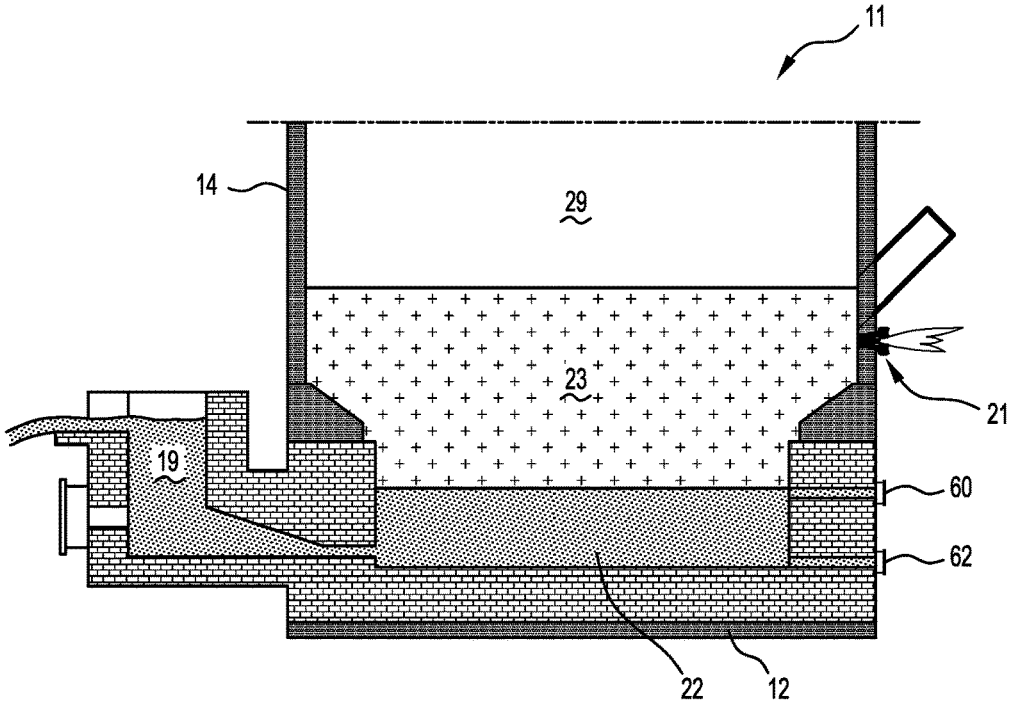
FIG. 2 is a vertical cross-section through another embodiment of a HIsmelt direct smelting vessel in accordance with the invention, which is similar to the FIG. 1 embodiment and includes additional disclosure in relation to slag tapping from the vessel.

FIG. 2 illustrates another embodiment of a HIsmelt direct smelting vessel 11 in accordance with the invention that is similar to the FIG. 1 embodiment and includes additional disclosure in relation to slag tapping from the vessel 11. The vessel 11 in FIG. 2 has the same basic structural features as the vessel 11 shown in FIG. 1 and the same reference numerals are used to describe the same features in both Figures.

FIGS. 3 to 8 show further details of the slag notch 21 shown in FIG. 2.

Figure 3:
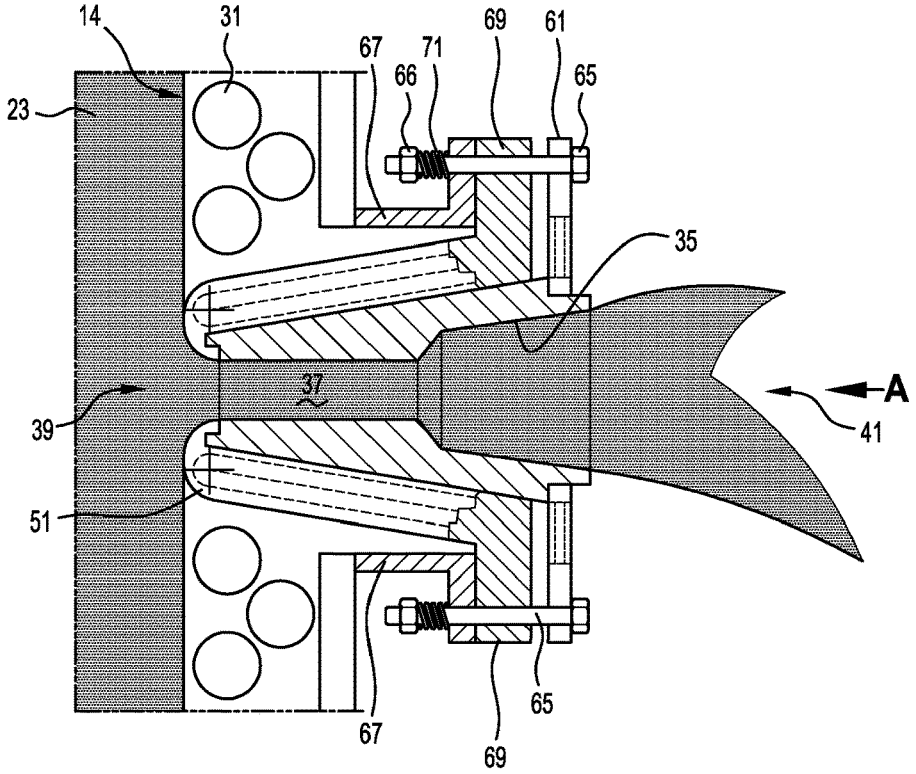
FIG. 3 is a more detailed cross-sectional view of the section of the side wall of the vessel shown in FIG. 2 that includes the slag notch of the vessel, the slag notch being one embodiment of the slag notch of the invention.
Figure 7:
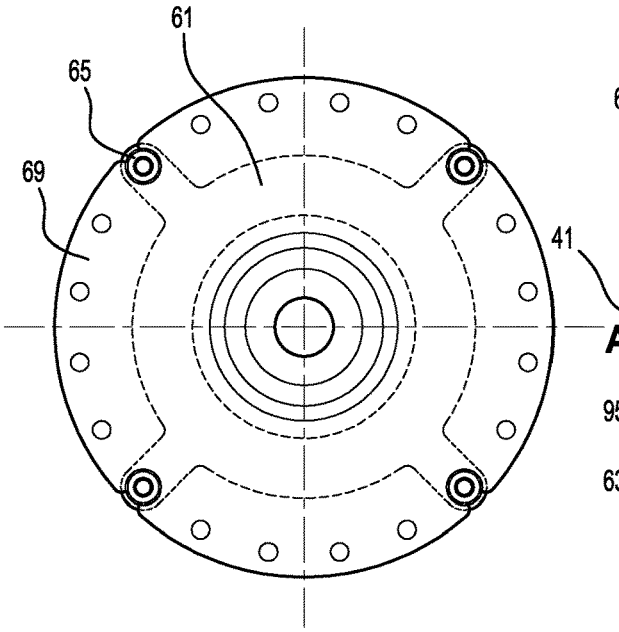
FIG. 7 is an end view of the slag notch shown in FIGS. 3 and 4 in the direction of the arrows "A" in FIGS. 3 and 4.
Figure 4:
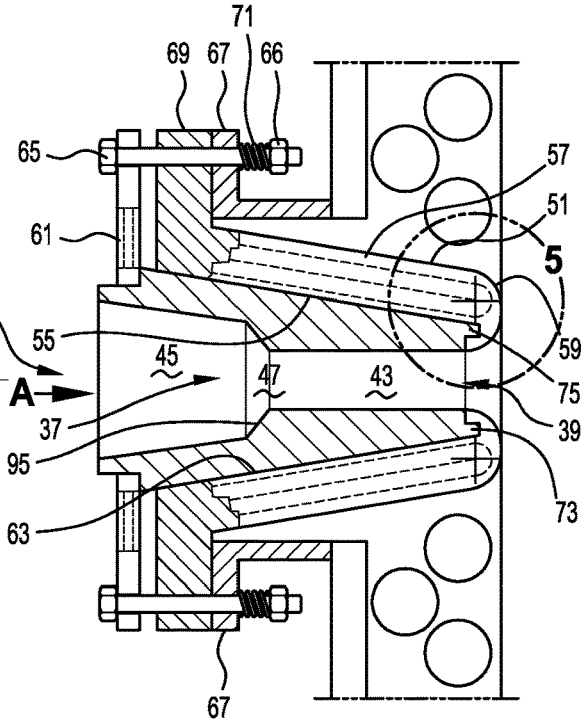
FIG. 4 is a cross-sectional view of the section of the side wall of the vessel and the slag notch shown in FIG. 3 without the molten slag.
Figure 5:
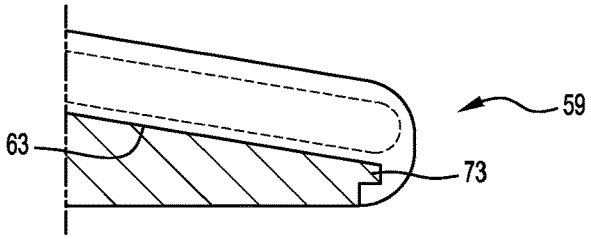
FIG. 5 is a detailed cross-sectional view of part of the bullnose end of the copper jacket of the slag notch shown in FIGS. 3 and 4.

FIG. 3 is an enlargement of the section of the side wall 14 of the vessel 11 in which the slag notch 21 is located. The Figure illustrates the water-cooled panels that form the side wall 14 of the vessel 11. These water-cooled panels are typically steel panels with internal water passages 31. In use, water is circulated through the water passages 31 to extract heat from the panels and maintain the panels at a safe operational temperature. FIG. 4 is similar to FIG. 3, but in the reverse orientation, and without molten slag 23.

With reference to FIGS. 3 to 8, the slag notch 21 includes:

(a) a steel member 35 in the form of a solid steel sleeve (shown by shading) that defines a passageway 37 for molten slag, the passageway 37 having an inlet 39 for molten slag at one end of the passageway and an outlet 41 for discharging molten slag from the passageway at the other end of the passageway, and (b) a system for cooling the steel member 35.

The applicant has found that the steel member 35 makes it possible for the slag notch to retain structural integrity under the operating temperatures experienced by the steel member when the steel member is cooled, for example by being directly or indirectly water cooled to a required extent.

Figure 6:
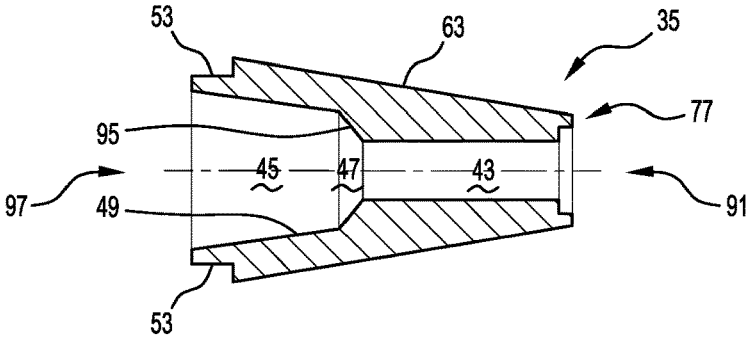
FIG. 6 is a cross-sectional view of the steel sleeve of the slag notch shown in FIGS. 3 and 4.

With reference to FIG. 6, the steel member 35 has a forward end 91, a wider rear end 97, and an inner wall 49 (which defines the passageway 37) and an outer wall 63 extending between the forward end 91 and the rear end 97. The outer wall is frusto-conical, increasing in diameter from the forward end 91 to the rear end 97.

The diameter of the passageway 37 is different in different parts of the length of the passageway 37 from the inlet end 39 to the outlet end 41 of the passageway. Specifically, the passageway 37 includes a first section 43 that has a constant diameter for a part of the length of the passageway from the inlet end 39 of the passageway and a second section 45 that has a larger diameter than the first section 43 for the remainder of the length of the passageway 37 to the outlet end 41 of the passageway. The second section 45 is frusto-conical, with the diameter increasing towards the outlet end 41 of the passageway. The passageway 37 includes a shoulder 95 that defines a transition 47 between the first section 43 and the second section 45 of the passageway 37. This structure of the passageway 37 makes it possible to minimise the diameter at the inlet end 39 of the passageway 37 to minimise the possibility of metal intrusions into the passageway 37 and to facilitate positioning a mud gun (see FIG. 8) or other suitable apparatus for forcing a plugging material 79 (see FIG. 8) into the passageway 37 to close the passageway 37 at an end of a slag tap from the vessel 11.

The system for cooling the steel member 35 in the embodiment shown in FIGS. 3 to 8 cools the steel member 35 indirectly via heat exchange between the steel member 35 and a heat extraction element positioned in relation to the steel member 35.

With further reference to FIGS. 3 to 8, the heat extraction element is in the form of a copper jacket 51 that is positioned around and houses the steel member 37 to facilitate heat transfer from the steel member 35 to the copper jacket 51.

It is noted that the invention is not confined to forming the jacket 51 from copper and the jacket 51 may be made from any suitable high thermal conductivity material.

The copper jacket 51 is water-cooled. The water-cooled copper jacket 51 has a forward end, a wider rear end, and an inner wall 55 and an outer wall 57 extending between the forward end and the rear end, a bullnose 59 at the forward end adjacent the inlet end of the passageway 37. The copper jacket 51 includes a series of water flow passages (indicated by the dashed lines in FIGS. 3 and 4) for water to flow from a water inlet (not shown) in the rear end of the jacket 51 and to the forward end of the jacket 51 and through the bullnose 59 at the forward end and rearwardly to a water outlet (not shown) at the rear end of the jacket 51. The water flow passages may be any suitable arrangement of passages. The water is discharged via the water outlet. The water flow to and from the copper jacket 51 may be any suitable water flow system.

The water supply system is not specifically shown in the Figure. The system may be any system for supplying water. The system may be a closed loop system with water being recirculated through the system and a heat exchanger or other heat extraction option to remove heat from the water. The system may be adapted to supply a constant water flow rate. Alternatively, the system may be adapted to supply variable water flow rates. Variations in water flow rates may be required depending on the operating conditions in the vessel 11. The system may include temperature sensors and other sensors (such as sensors that monitor heat load or heat flux removed via the water flow) to monitor the condition of the steel member 35 and to adjust water flow rates to maintain the temperature of the steel member 35 within a predetermined operating temperature range.

The copper jacket 51 contacts the steel member 35 at least substantially along the length of the steel member 35 between the inlet end 39 and the outlet end 41 of the passageway 37. The inner wall 55 of the copper jacket 51 and an outer wall 63 of the steel member 35 are formed so that there is a tight fit of the steel member 35 within the copper jacket 51 to maximise heat transfer across the interface between the two elements 51, 35.

The copper jacket 51 and the steel member 35 are separate units that are typically positioned as separate units into a slag notch opening (which is evident from the drawings but not indicated by a specific reference numeral) and are coupled to the side wall 14 of the vessel 11 and thereby maintained in position in the slag notch opening. The structure of the copper jacket 51 and the steel member 35 makes it possible to efficiently position and remove the slag notch 21 form the slag notch opening.

The slag notch 21 includes a retaining element 61 such as a plate that contacts the steel member 35 and forces the steel member 35 into and retains the steel member 35 in the internal space defined by the copper jacket 51 so that the inner wall 55 of the copper jacket 51 and the outer wall 63 of the steel member 35 are in close contact across the whole of the surface areas of the walls 55, 63 between the inlet end 39 and the outlet end 41 of the passageway 37.

The slag notch 21 includes a coupling member in the form of a plurality of bolts 65 and nuts 66 or other suitable coupling elements that couple the retaining element 61 and the copper jacket 51 to the side wall 14 of the vessel 11 and thereby retain the steel sleeve 35 and the copper jacket 51 in an operative position in the slag notch opening. As can best be seen in FIG. 7, the retaining element 61 is an annular plate with a number of openings around the perimeter of the plate. The openings receive the bolts 65. With reference to FIGS. 3 and 4, the copper jacket 51 includes an annular flange 69 with a number of openings for the bolts 65. In addition, the side wall 14 of the vessel 11 includes an annular flange 67 with a number of openings for the bolts 65. The bolts 65 are positioned to extend through aligned openings in the retaining element 61, the copper jacket 51, and the annular flange 67 and hold the retaining element 61 and the copper jacket 51 to the side wall 14 of the vessel 11. The coupling member includes springs 71 that provide a degree of flexibility. The rear end of the steel member 35 is formed with an annular shoulder 53 (see FIG. 6) which facilitates locating the retaining element 61 against the steel member 35.

In order to assemble the copper jacket 51 and the steel member 35 together, the copper jacket 51 is inserted into the slag notch opening in the side wall 14 of the vessel 11 from outside the vessel 11. The steel member 35 is then inserted from outside the vessel 11 into the internal space defined by the copper jacket 51 so that the steel member 35 and the copper jacket 51 are in an operative position (as shown in FIGS. 3 and 4) with the steel member 35 contacting the copper jacket 51 at least substantially along the length of the steel member 35. The retaining element 61 is then positioned as shown in FIGS. 3 and 4 and the bolts 65 are threaded through aligned openings in the retaining element 61, the flange 69 of the jacket 51, and the flange 65 of the side wall 14 of the vessel 11, and nuts 66 are threaded onto and tightened on the bolts 65 and apply a force that couples the retaining element 61 and the copper jacket 51 to the side wall 14 and prevents withdrawal of the steel member 35 from the internal space defined by the copper jacket 51 and thereby holds the steel member 35 and the copper jacket 51 in the operative position shown in these Figures in the slag notch opening.

The bullnose 59 of the copper jacket 51 includes a lip 73 that extends inwardly of the passageway 37 and defines an annular recess 75. The forward end 77 of the steel member 35 (see FIG. 6) has a complementary profile to that of the lip 73 and the recess 75 so that the forward end 77 extends into the recess 75 and forms an uninterrupted transition from the lip 73 to the inner wall of the steel member 35. The arrangement minimises the risk of flow of molten slag through the inlet 39 and into the interface between the steel member 35 and the copper jacket 51.

FIGS. 3 to 7 show the slag notch 21 with the passageway 37 in an open position in which slag can flow through the open inlet end 39 of the passageway 37 along the length of the passageway 37 and be discharged from the outlet end 41 of the passageway.

Figure 8:
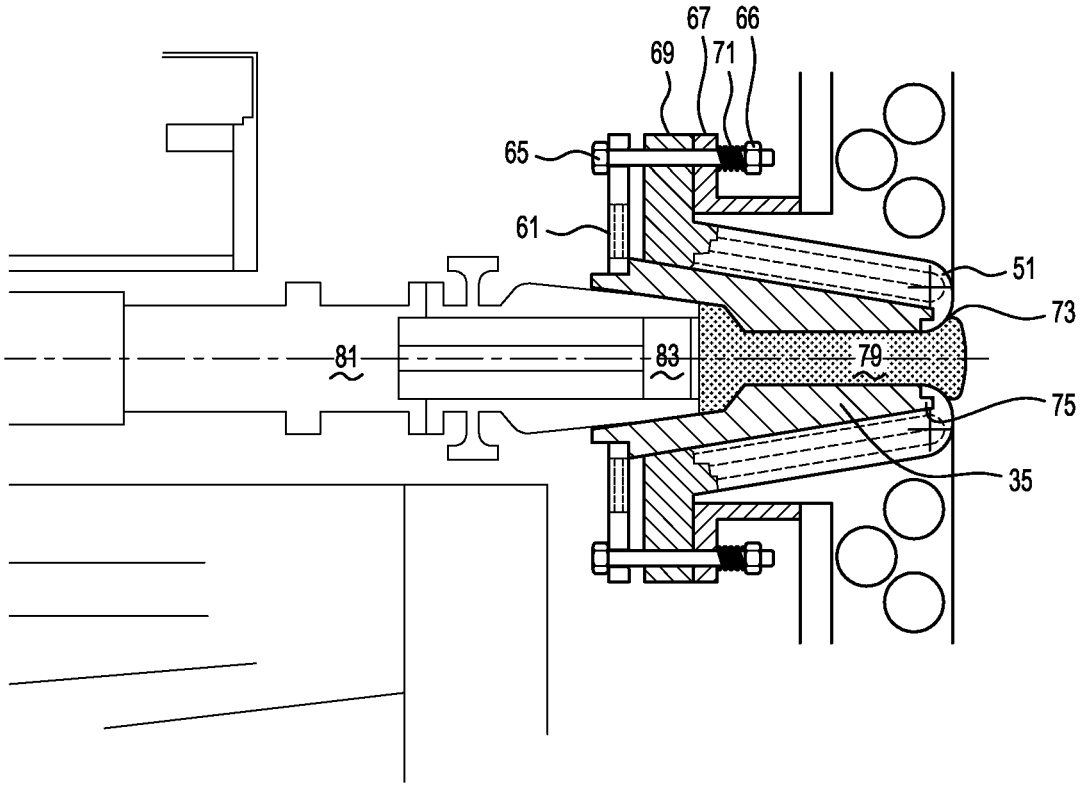
FIG. 8 is a cross-sectional view of the section of the side wall of the vessel and the slag notch shown in FIGS. 3 and 4 which illustrates the operation of a mud gun to insert a plugging material into the passageway of the slag notch to close the passageway.

FIG. 8 shows the passageway 37 in a closed position with a plugging material 79 blocking a substantial part of the length of the passageway 37. The Figure shows a part of a mud gun 81 with a forwardly extended ram 83 forcing the plugging material 79 into the passageway 37. The plugging operation takes places at the end of each slag tap. A drill assembly (not shown) is used to drill through the plugging material 79 and open the passageway 37 when the next slag tap is required.

In the embodiment shown in FIG. 8, the plugging material fills the forward section of the passageway 37 so that, between slag taps, there is no molten slag in the passageway 37.

Figure 10:
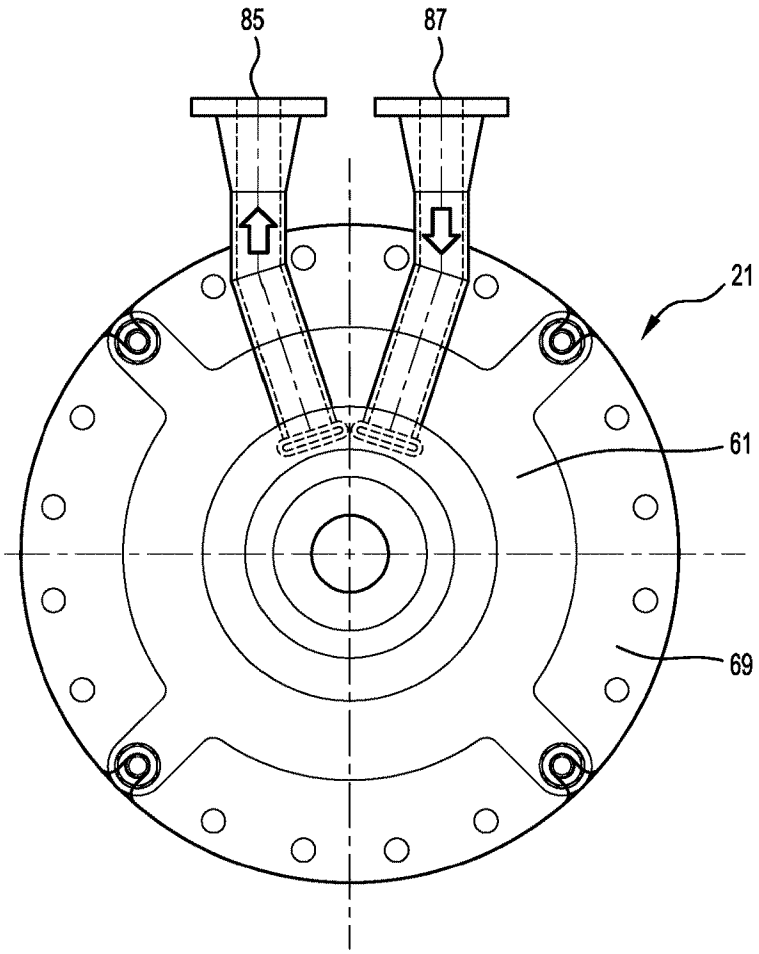
FIG. 10 is an end view of the slag notch shown in FIG. 9 in the direction of the arrow "A" in FIG. 9.
Figure 9:
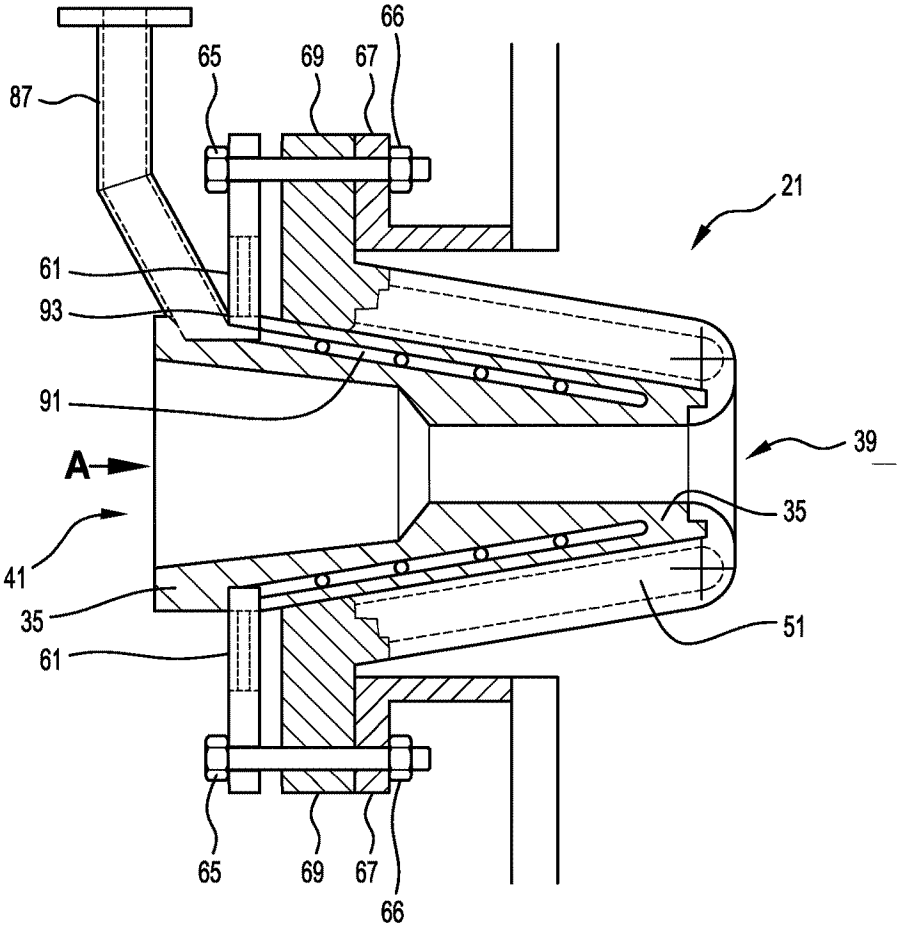
FIG. 9 is a cross-sectional view of another, although not the only other, embodiment of a slag notch in accordance with the invention.
Figure 11:
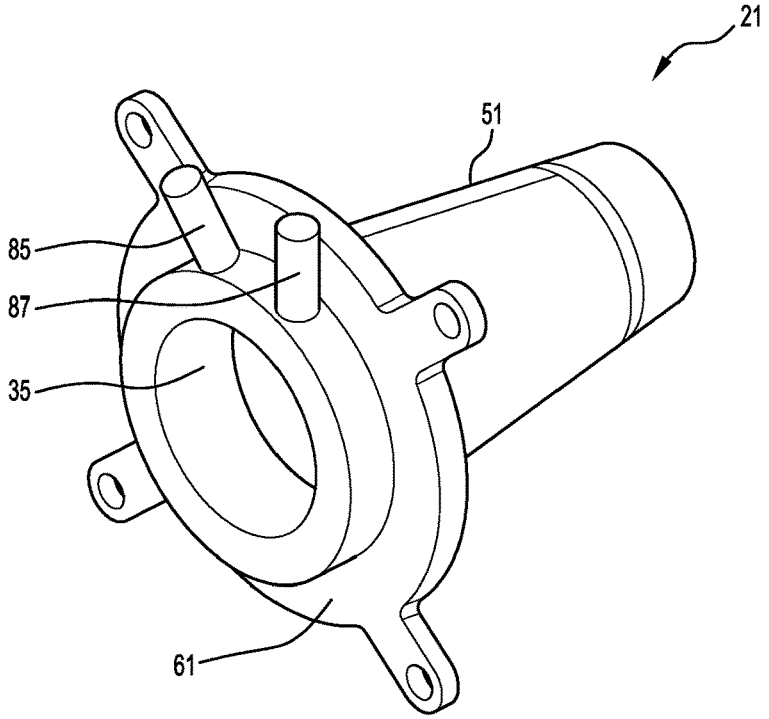
FIG. 11 is a perspective view of the slag notch shown in FIGS. 9 and 10.

The embodiment shown in FIGS. 9 to 11 is very similar in many respects to the embodiment shown in FIGS. 3 to 8 and the same reference numerals are used to describe the same features.

Specifically, the slag notch 21 shown in FIGS. 9 to 11 includes a steel member 35 in the form of a sleeve that defines a passageway 37 for slag to flow from an inlet end 39 of the passageway 37 into the passageway 37 and along the length of the passageway 37 and be discharged from an outlet end 41 of the passageway 37. The slag notch 21 also includes a water-cooled copper jacket 51 that is positioned around and in heat transfer relationship with the steel member 35 to remove heat from the steel member 35.

In the embodiment shown in FIGS. 9 to 11, the system for cooling the steel member 35 is also adapted to cool the steel member 35 directly via water flow within the steel member 35.

Specifically, the steel member 35 includes a series of internal water flow passages 91 that extend, in this embodiment, in a spiral path from a rear end to a forward end of the steel member 35 and then in a return path to the rear end of the steel member 35. The cooling system includes a water inlet pipe 87 and a water outlet pipe 85. In this embodiment, the retaining member 61 in the form of a steel plate is welded to the steel member 35. This arrangement can best be seen in the perspective view of the steel member 35 in FIG. 1. In addition, the welds are identified by the numeral 93 in FIG. 9.

The retaining element may be connected, for example by being welded, to the steel member.

Figure 12:
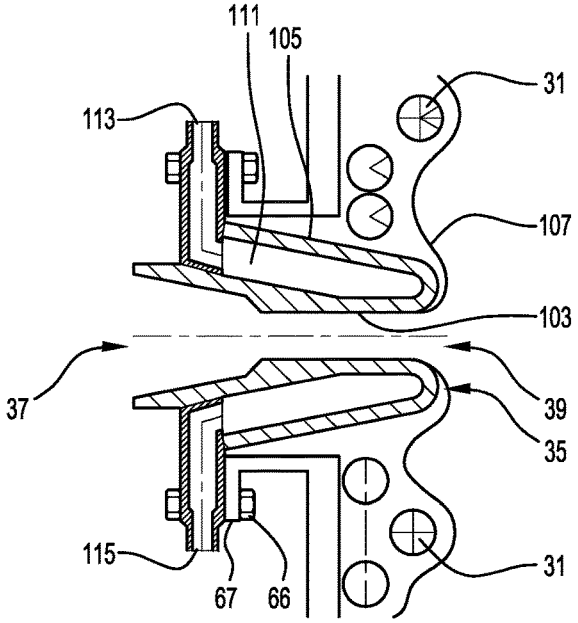
FIG. 12 is a cross-sectional view of another, although not the only other, embodiment of a slag notch in accordance with the invention.

In the embodiment shown in FIG. 12, which is not the only other embodiment of the invention, the indirect water cooling of the steel member 35 is replaced altogether by direct water cooling of the steel member 35. In this embodiment the water-cooled steel member 35 is in the form of a water-cooled steel jacket that has an inner wall and an outer wall 105 and a bullnose end 107 adjacent the inlet end 39 of the passageway 37 and an internal chamber 101 and a water inlet 113 and a water outlet 115 from supplying water to and removing water from the chamber 101.

Whilst a number of specific apparatus and method embodiments have been described in relation to the Figures, it should be appreciated that the apparatus and method may be embodied in many other forms.

By way of example, the invention also extends to embodiments in which the steel member 35 is water cooled, for example as shown in embodiment of FIGS. 9 to 11 and a heat extraction element that is in the form of a solid outer element rather than a water-cooled jacket 51 of the embodiments of FIGS. 2 to 8 and 9 to 11. These are effective embodiments provided there is sufficient heat extraction via the water cooling of the steel member 35 and the thermal mass of the solid heat extraction element.

By way of further example, whilst the embodiments described in relation to the Figures include steel members 35 in the form of sleeves and jackets, it can readily be appreciated the invention is not confined to these elements and extends to any suitable steel members that define passageways 37 for molten slag.

By way of further example, whilst the embodiments described in relation to the Figures include water as a coolant, it can readily be appreciated the invention is not confined to the use of water and extends to the use of any suitable coolant.

By way of further example, whilst the embodiments described in relation to the Figures include an external heat extraction element in the form of a jacket 51, it can readily be appreciated the invention is not confined to the use of jackets and extends to the use of any suitable external heat extraction element.

By way of further example, whilst the embodiments described in relation to the Figures include an external heat extraction element in the form of a jacket 51 made from copper, it can readily be appreciated the invention is not confined to the use of copper and extends to the use of any suitable high thermal conductivity material.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the apparatus and method as disclosed herein.

The invention claimed is:

1. A slag notch for periodically discharging molten slag from a metallurgical vessel containing a bath of molten metal and molten slag, the slag notch including:

a steel member that defines a passageway for the molten slag, the passageway includes a first section that has a constant diameter for a part of the length of the passageway from an inlet end of the passageway and a second section that has a larger diameter than the first section for remainder of the length of the passageway to an outlet end of the passageway, and a shoulder extending divergently from the first section to the second section, wherein the shoulder defines a transition region in the passageway; and a system for cooling the steel member, wherein the system includes a jacket, and a retaining element for coupling the steel member and the jacket to the metallurgical vessel and for retaining the steel member in an internal space defined by the jacket so that an inner wall of the jacket and an outer wall of the steel member are in physical contact across the whole of the surface areas of these walls at least substantially along the length of the steel member between the inlet end and the outlet end of the passageway to maximize heat transfer from the steel member to the jacket.

2. The slag notch defined in claim 1 wherein the diameter of the passageway is different in different parts of the length of the passageway from the inlet end to the outlet end of the passageway.

3. The slag notch defined in claim 1 wherein the steel member includes a forward end, a rear end, and the inner wall which defines the passageway and the outer wall extending between the rear end and the forward end.

4. The slag notch defined in claim 3 wherein the outer wall of the steel member is frusto-conical, increasing in diameter from the forward end to the rear end.

5. The slag notch defined in claim 1 wherein the system for cooling the steel member is adapted to cool the steel member internally via coolant flow within the steel member.

6. The slag notch defined in claim 5 wherein the steel member is a water-cooled steel member.

7. The slag notch defined in claim 6 wherein the water-cooled steel member is a water-cooled steel sleeve.

8. The slag notch defined in claim 7 wherein the water-cooled steel sleeve includes a forward end, a rear end, an inner wall (which defines the passageway) and an outer wall extending between the rear end and the forward end, and water flow passages within the water-cooled steel sleeve.

9. The slag notch defined in claim 1 wherein the system for cooling the steel member is adapted to cool the steel member indirectly via heat exchange between the steel member and a heat extraction element positioned in relation to the steel member.

10. The slag notch defined in claim 9 wherein the heat extraction element is positioned around and in heat transfer relationship with the steel member at least substantially along the length of the steel member between the inlet end and the outlet end of the passageway.

11. The slag notch defined in claim 10 wherein the heat extraction element and the steel member are separate units.

12. The slag notch defined in claim 10 wherein the heat extraction element is water-cooled.

13. The slag notch defined in any one of claim 10 wherein the heat extraction element includes a jacket having a forward end, a rear end, an inner wall and an outer wall extending between the rear end and the forward end, a bullnose at the forward end adjacent the inlet end of the passageway, and water flow passages within the jacket.

14. A metallurgical vessel that includes the slag notch defined in claim 1 in a side wall of the vessel.

15. A molten bath-based metallurgical process for direct smelting a metalliferous material in a metallurgical vessel that includes the slag notch defined in claim 1 in the vessel, the process including periodically tapping molten slag from the slag notch, and cooling the slag notch to maintain the steel member of the slag notch in a safe operating temperature range for slag tapping.

16. The slag notch of claim 1 wherein the retaining element is a plate.

17. The slag notch of claim 1 wherein the steel member and the jacket are coupled to a side wall of the metallurgical vessel.

* * * * *